US006196956B1

(12) United States Patent
Brown

(10) Patent No.: US 6,196,956 B1
(45) Date of Patent: Mar. 6, 2001

(54) CONSTANT VELOCITY UNIVERSAL JOINT FOR THERAPY DEVICES

(76) Inventor: William C. Brown, 13951 N. Scottsdale Rd., Suite 111-B, Scottsdale, AZ (US) 85254

( * ) Notice: Subject to any disclaimer, the term of this patent is extended or adjusted under 35 U.S.C. 154(b) by 0 days.

(21) Appl. No.: 08/807,874

(22) Filed: Feb. 26, 1997

Related U.S. Application Data

(63) Continuation-in-part of application No. 08/698,495, filed on Jul. 25, 1996, now abandoned.

(51) Int. Cl.[7] ..... A63B 21/00
(52) U.S. Cl. ..... 482/137; 487/905; 487/49
(58) Field of Search ..... 601/33, 34, 35, 601/89, 92, 93; 602/21–29, 16, 20, 5; 600/4; 482/100, 136, 137, 138

(56) References Cited

U.S. PATENT DOCUMENTS 4,259,944 * 4/1981 Axelsson ..... 601/33
4,996,977 * 3/1991 Tiedeken ..... 482/148
5,417,643 * 5/1995 Taylor ..... 601/33
5,558,624 * 9/1996 Hepburn ..... 601/33
5,951,499 * 9/1999 Saringer et al. ..... 601/33

* cited by examiner

*Primary Examiner*—Jerome W. Donnelly
(74) *Attorney, Agent, or Firm*—Ellis Venable & Busam, L.L.P.

(57) ABSTRACT

The present invention relates to the use of universal joints, especially constant velocity universal joints, to provide multi-axial rotational freedom on exercise, rehabilitation and testing machines. The universal joints may be an integral part of the exercise, rehabilitation and testing machines, or they be provided as adapters for use on uni-axial machines. Furthermore, the adapters may function to act as converters such that attachments designed for machines using a receiver apparatus may be used on machines with an input shaft. Conversely, the adapters may function to act as converters such that attachments designed for machines using an input shaft may be used on machines using an attachment receiver. Additionally, an improved apparatus attachment is provided which uses an arm/joint stabilizer to further support the arm and joint position. The apparatus attachment primarily comprises a lever arm with a hand grip attached to a first end and the arm/joint stabilizer attached to a second end. The apparatus attachment is adapted to be used with any of the embodiments of the adapters described herein.

9 Claims, 14 Drawing Sheets

CONSTANT VELOCITY UNIVERSAL JOINT FOR THERAPY DEVICES

This application is a continuation-in-part of a U. S. patent application Ser. No. 08/698,495, filed on Jul. 25, 1996 now abandoned.

BACKGROUND

The subject of this invention relates to physical rehabilitation and exercise machines. More particularly, but not by way of limitation, to an adapter for use on machines developed to exercise or rehabilitate arthroidial joints and attendant soft articular tissues which provides for multi-axial rotational freedom about an arthroidial joint axis and provides for a constant velocity of rotation regardless of angular deflection from said rotational axis.

PRIOR ART

Athletes, both weekend and professional, risk injury during a variety of activities. Usually, athletes are injured while practicing or competing in their sport. An overlooked area of potential injury to an athlete is during rehabilitation or strength conditioning. Additionally, the general population suffers from bodily injuries, both from accidents and overuse. Rehabilitation of these injuries typically involve repetitive motions that increase and restore strength or flexibility.

Conditioning is important in order to prevent future injury by increasing strength and/or flexibility in the athlete or individual. Moreover, rehabilitation is important in the restoration of strength, flexibility, and neural capacities necessary for everyday functioning.

Physical therapy rehabilitation and strength conditioning devices are in common use. These may range from simple free weights, to complex machinery that utilize cables, elastomers, chains and/or air pressure to provide resistance to bodily movement. An athlete will attempt to isolate muscles or joints and, using repetitive motions, rehabilitate, strengthen, or condition these tissues or joints. A majority of these physical therapy and exercise machines traditionally utilize repetitive motions around a single axis.

Many structural/muscle groups naturally use multi-axial movements and cannot effectively be exercised with conventional free weights or machines. These devices cannot duplicate the normal movement, or roll and glide of human joints. The athlete or individual places themselves at risk of injury when using a uni-axial machine as uni-axial rotation about arthrodial joints causes unnatural stresses and strains on both the articular tissues such as muscles, ligaments, tendons, and nerves and the bones and joints involved in the repetitive movement. Furthermore, these stresses and strains have harmful effects on strength conditioning and rehabilitation.

In particular, the shoulder is a particularly difficult part of the body to condition or rehabilitate. This is because the shoulder is comprised of four primary joints: the sternoclavicular joint; the acromioclavicular joint; the glenohumeral joint; and the scapulothoracic joint. All these joints have multi-axial movements. Coupling the multi-axial motions of these four joints results in a continuously changing instant axis of rotation through most shoulder motions. These joints, when moving in combination, provide the shoulder with global free movement.

Several machines have been invented that try to reduce unnatural stresses or strains resulting from a single rotational axis device. U.S. Pat. No. 5,368,536, issued to Stodgell, discloses the use of a ball and joint arrangement for providing a more natural multi-axial movement during ankle rehabilitation. The ball and joint in this invention approximates natural movement of a human joint, but the movement is about a point outside of the body, i.e., the ball and socket joint. Thus this device suffers from the same shortcomings as uni-axial devices. Namely, it places unnatural stresses and strains upon the joint being utilized. This device includes a tensioning device located at the ball and socket for providing isotonically tensioned exercises. Alternatively, concentric and eccentric exercises utilize a second spring tensioned linkage.

U.S. Pat. No. 5,336,138, issued to Arjawat, also discloses a simple ball and joint for closely mimicking the natural motions of a person's cervical region. This invention provides for movement within a plane of motion that is infinitely adjustable. As such, this device suffers from the same shortcomings as uni-axial devices.

U.S. Pat. No. 5,391,132, issued to Greenwald, describes a device that utilizes two degrees of rotation. The primary axis of rotation corresponds with rotator cuff movements. A secondary axis of movement allows for slight changes in orientation of the rotator cuff. This is accomplished using two separate pivot points.

None of the known prior art neither specifically describe, teach, nor suggest an exercise method or device which allows for a natural movement of the body's arthrodial joints. At most, they provide for a mimicry of natural movement about a point outside of the arthroidial joint. Additionally, none of the known prior art teaches or suggest the use of universal joints or constant velocity universal joints to aid rehabilitation or conditioning by providing a mechanism in which a body's arthroidial joint may move along their natural lines of movement.

The present invention utilizes multi-axial rotations and alignment that more accurately duplicates the physiological roll and glide of arthrodial joints during movement by specific muscle groups.

SUMMARY OF THE INVENTION

It is therefore an object of the present invention to provide a device which is useful in the conditioning or rehabilitation of joints and surrounding articular tissues by providing for motion that corresponds with natural body motions.

It is another object of the present invention to provide a device which provides multi-axial rotation of attachments on conditioning or rehabilitation apparatus.

It is still yet another object of the present invention to provide a multi-axial rotational axis adapter that uses a universal joint to provide the multi-axial rotational axis.

It is a further object of the present invention to provide a multi-axial rotational axis adapter that uses a constant velocity universal joint to provide the multi-axial rotational axis.

It is yet another object of the present invention to provide a multi-axial rotational axis adapter that attaches to an attachment shaft portion of an exercise or rehabilitation device and provides a matching adapter attachment shaft portion.

It is a further object of the present invention to provide a multi-axial rotational axis adapter that attaches to a receiver portion of an exercise or rehabilitation device and provides a matching adapter receiver portion.

It is a further object of the present invention to provide a multi-axial rotational axis adapter that attaches to an attachment shaft portion of an exercise or rehabilitation device and provides a receiver portion for converting the exercise or rehabilitation device from a shaft attached device to a receiver attached device.

It is a further object of the present invention to provide a multi-axial rotational axis adapter that attaches to an attachment receiver of an exercise or rehabilitation device and provides an attachment shaft portion for converting a receiver attached device into a shaft attached device.

Another object of the present invention is to provide a method for using a rehabilitation device that includes a universal joint to provide multi-axial rotational freedom.

DESCRIPTION OF PREFERRED EMBODIMENTS

Figure 1:
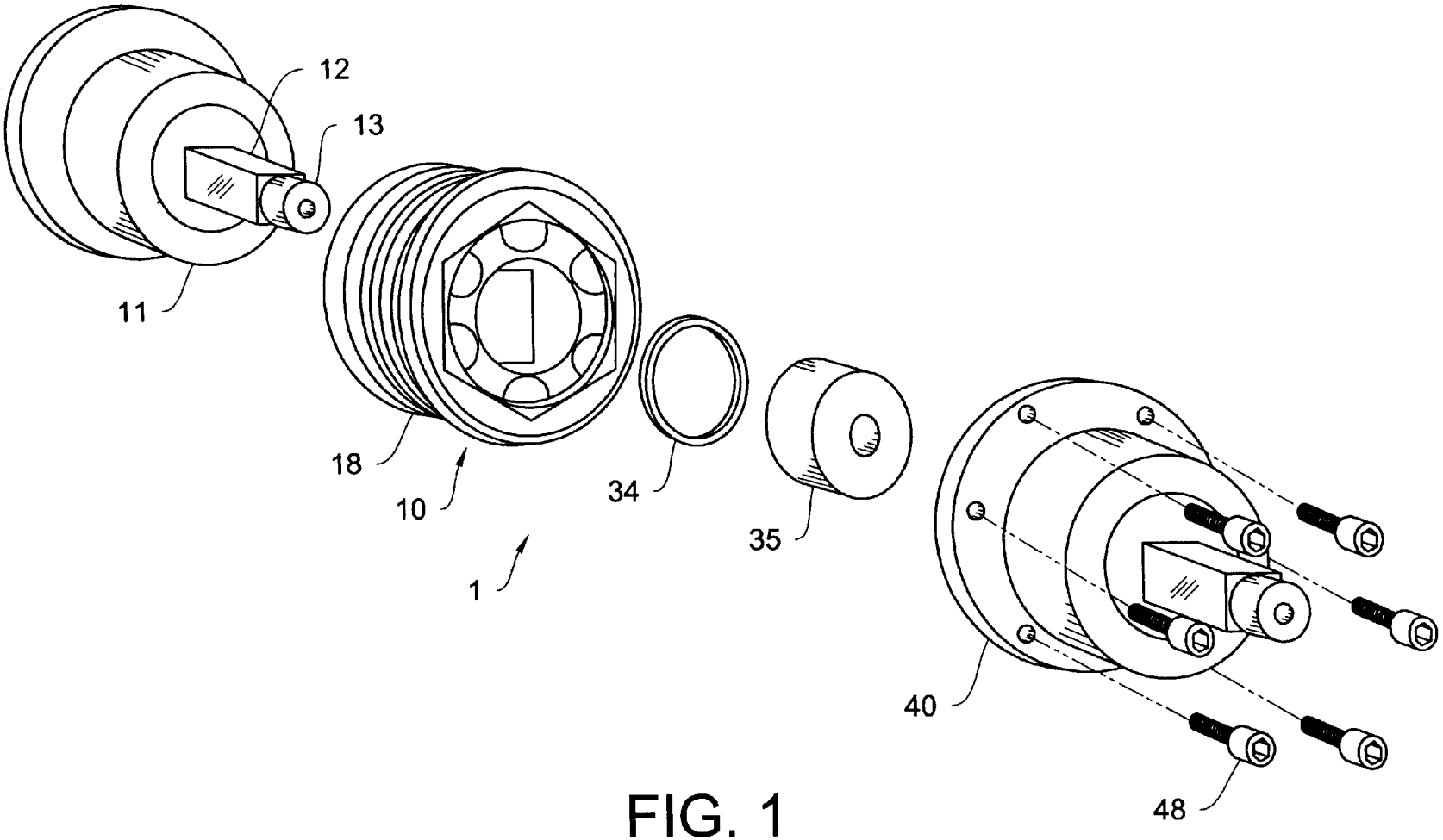
FIG. 1 is an exploded perspective drawing of a first preferred embodiment, including a constant velocity universal joint.
Figure 2B:
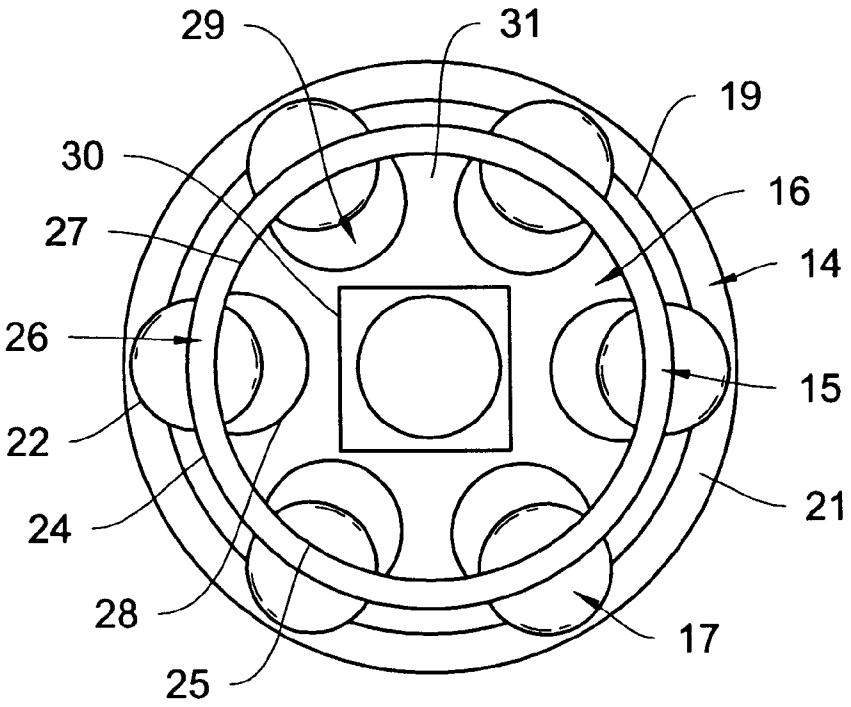
FIG. 2*b* is a rear view of the constant velocity universal joint.
Figure 2A:
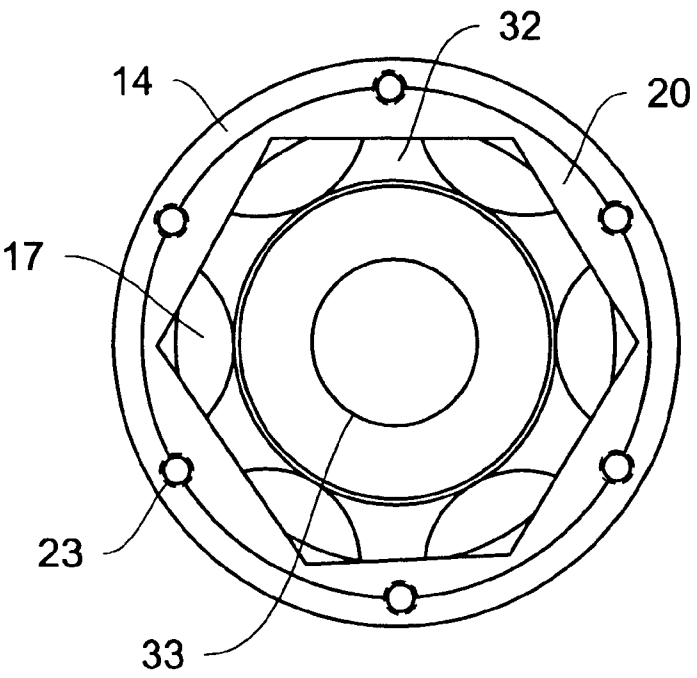
FIG. 2*a* is a front view of the constant velocity universal joint.
Figure 3B:
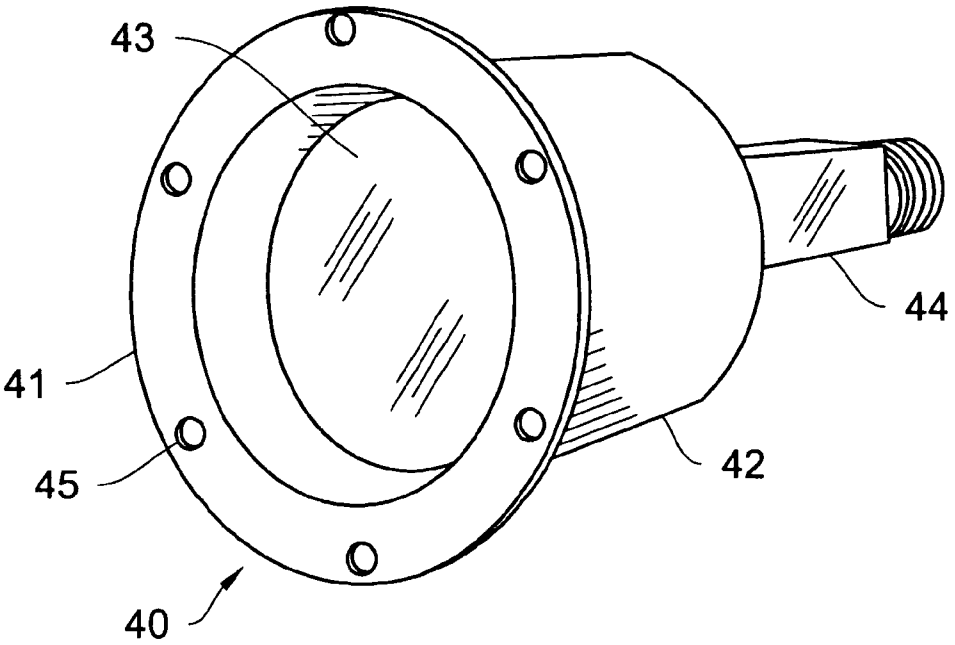
FIG. 3*b* is a rear perspective of the adapter cap of the first preferred embodiment.
Figure 3A:
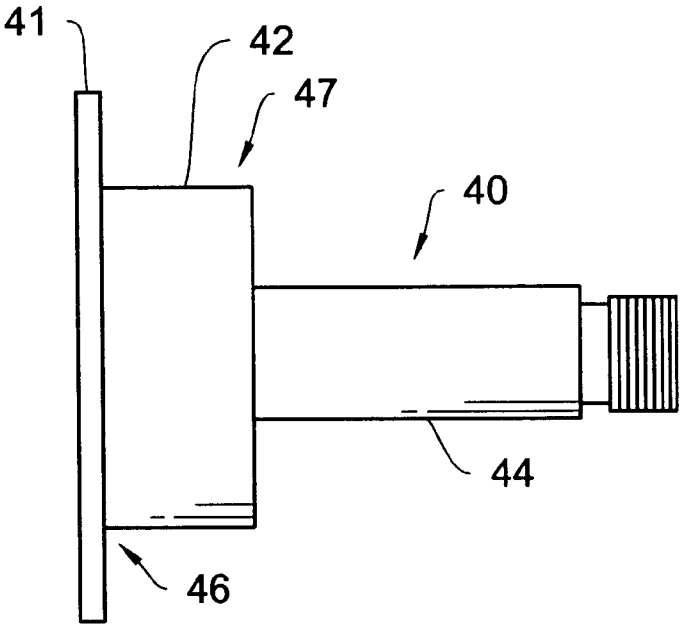
FIG. 3*a* is a side view of an adapter cap of the first preferred embodiment.
Figure 4:
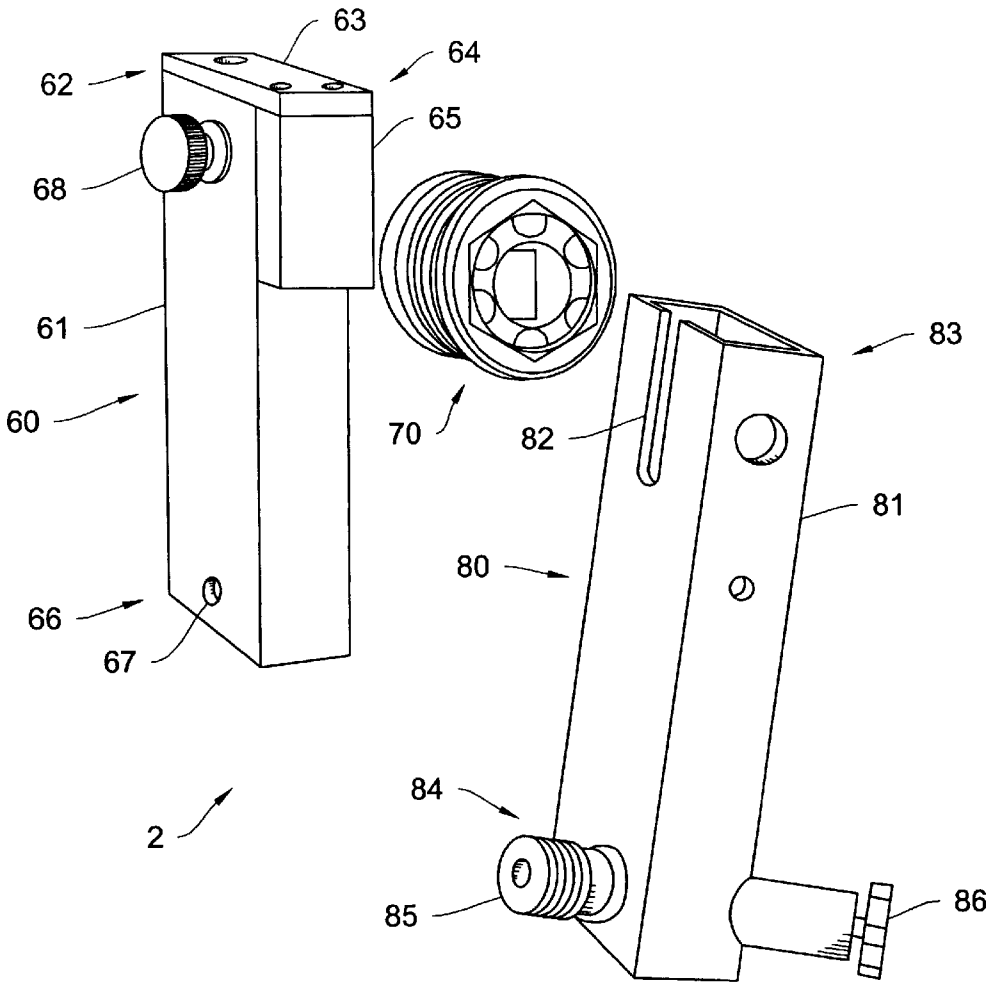
FIG. 4 is an exploded perspective drawing of a second preferred embodiment.
Figure 5:
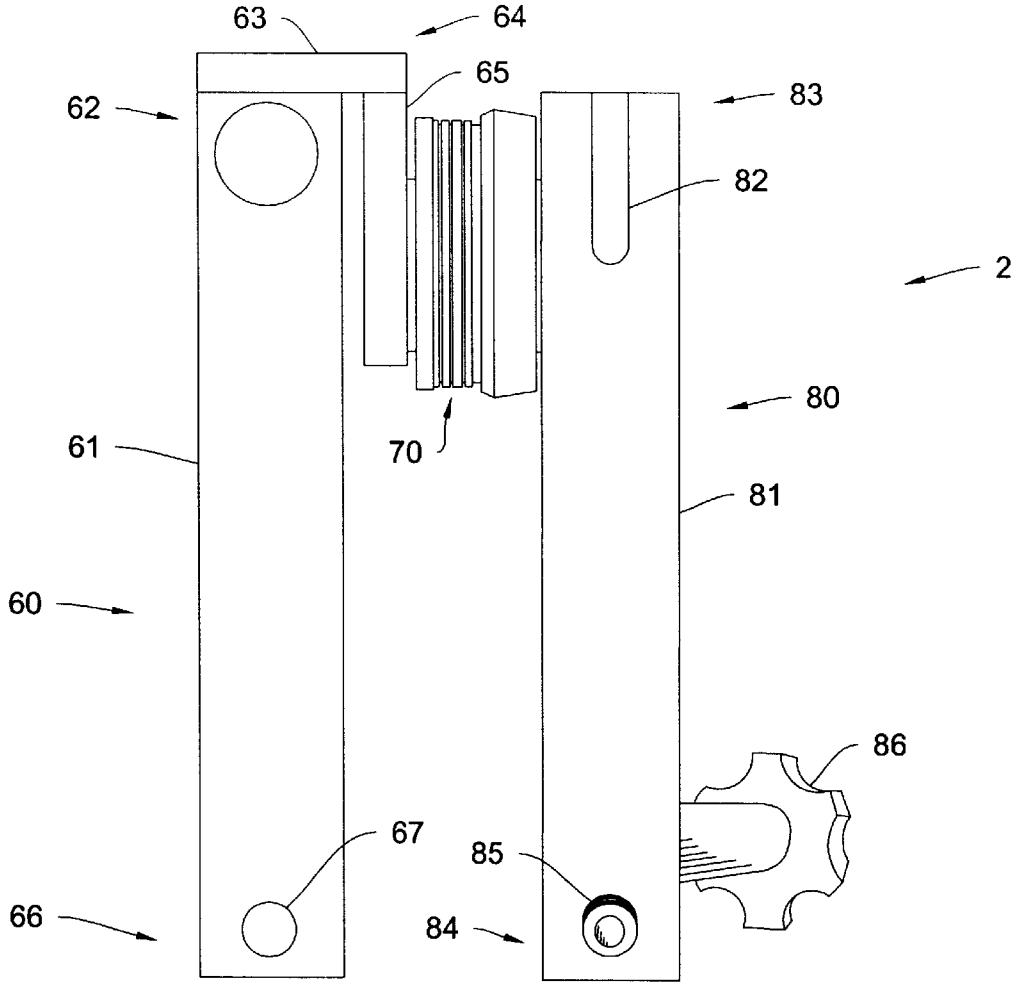
FIG. 5 is a side view of the second preferred embodiment.
Figure 6:
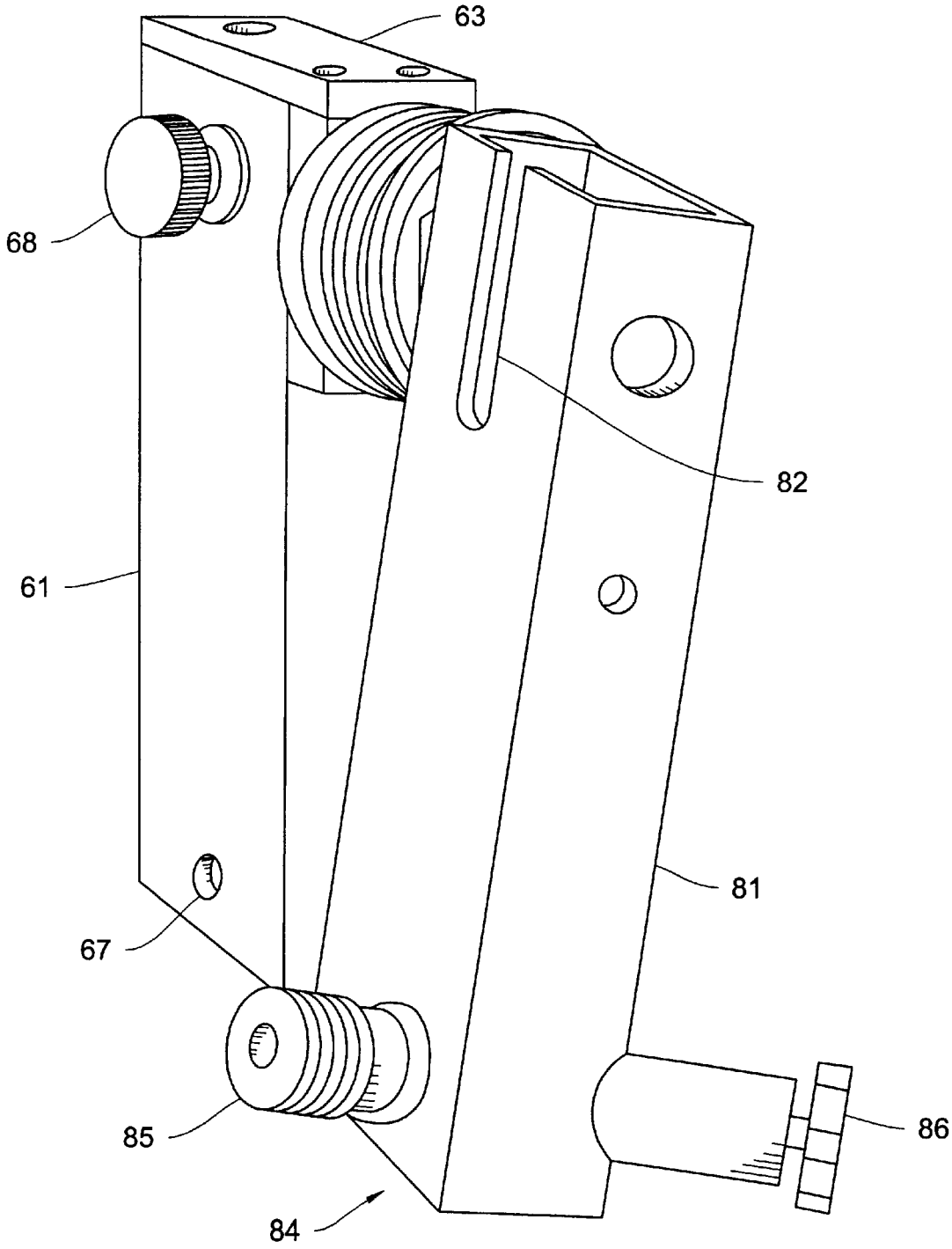
FIG. 6 is a perspective view of the intact second preferred embodiment.
Figure 7:
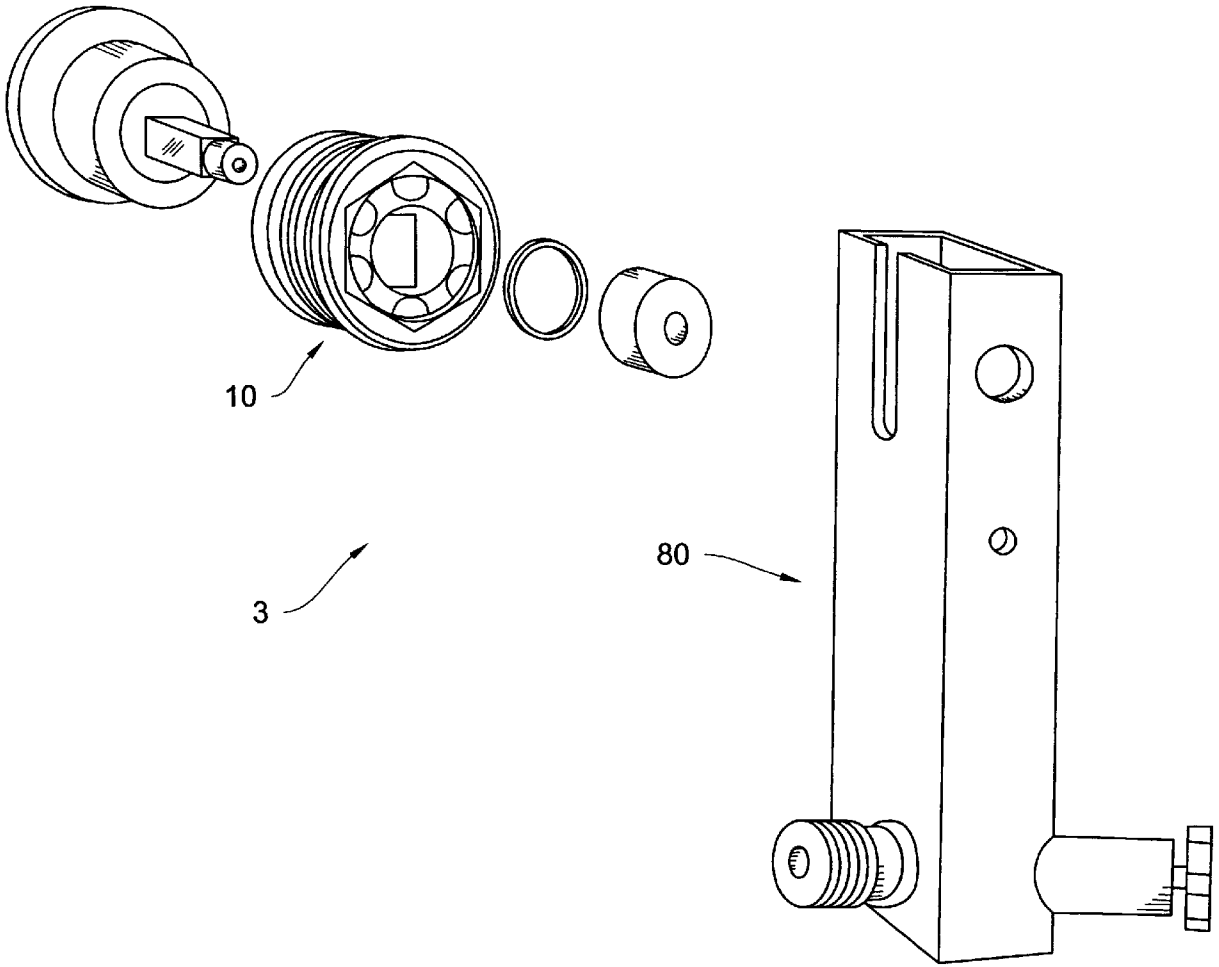
FIG. 7 is an exploded view of a third preferred embodiment.
Figure 8:
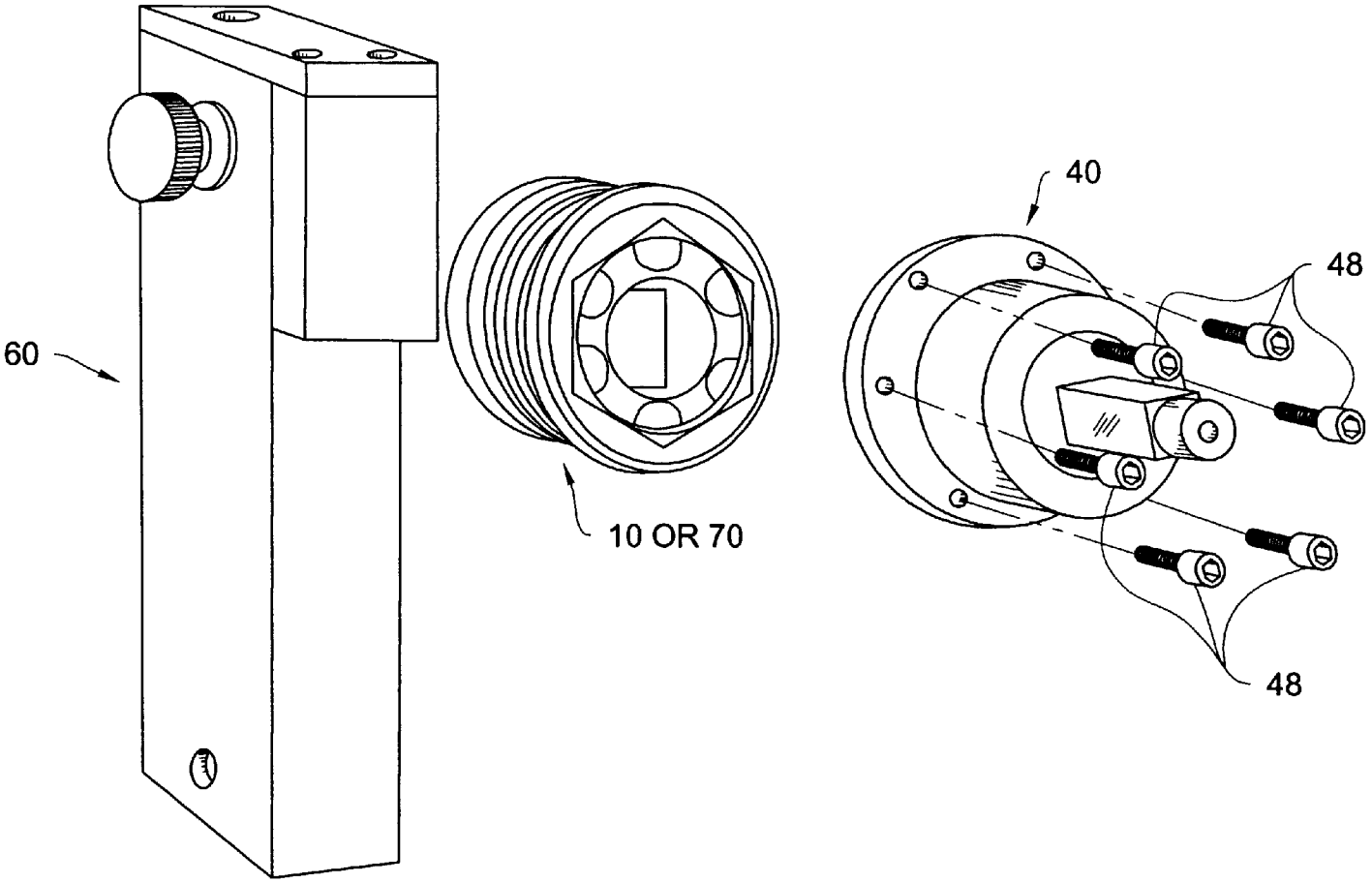
FIG. 8 is an exploded view of a forth preferred embodiment.
Figure 9:
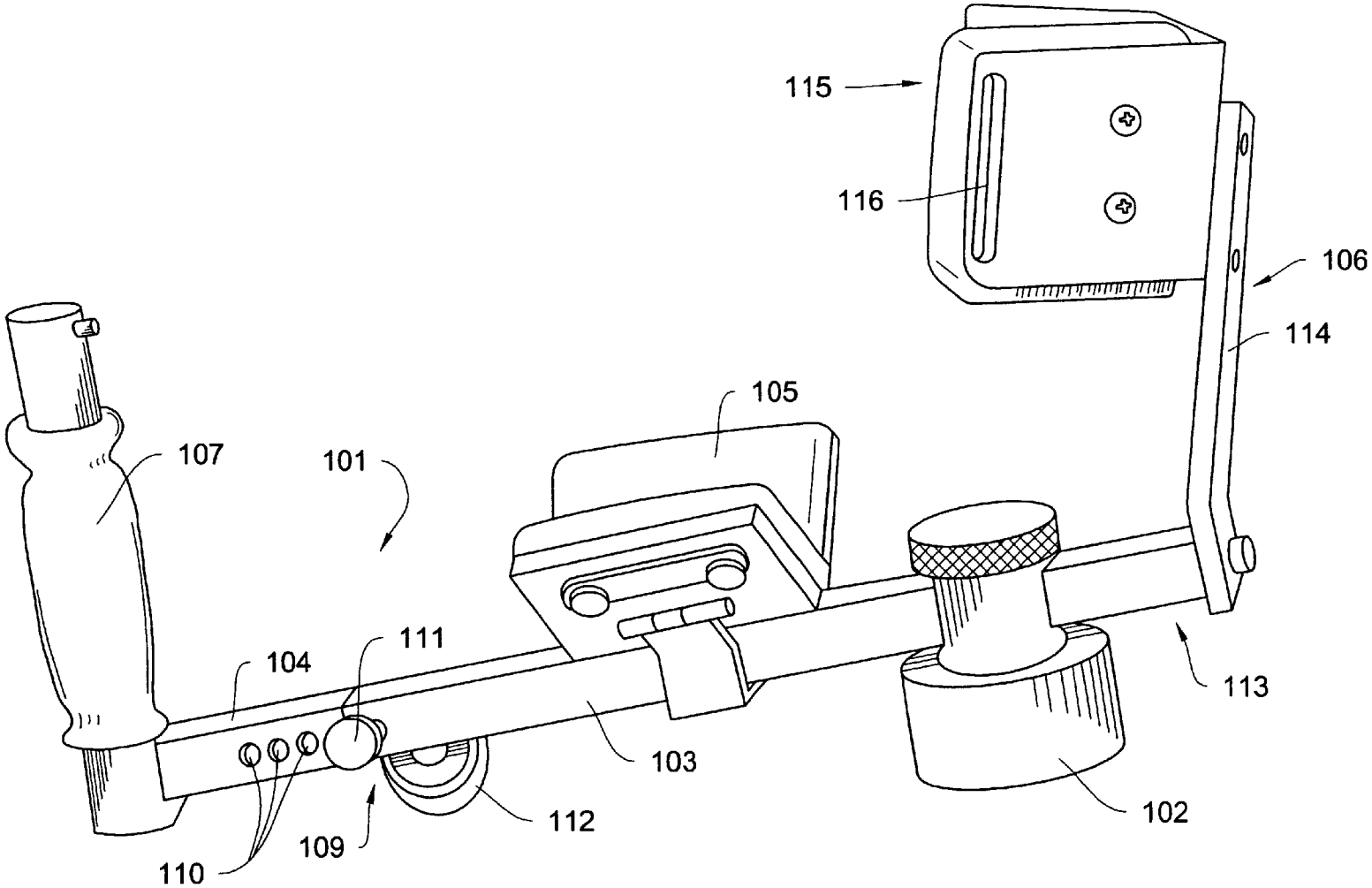
FIG. 9 is a side view of the first embodiment of the present invention with an optional arm/joint stabilizer.
Figure 10:
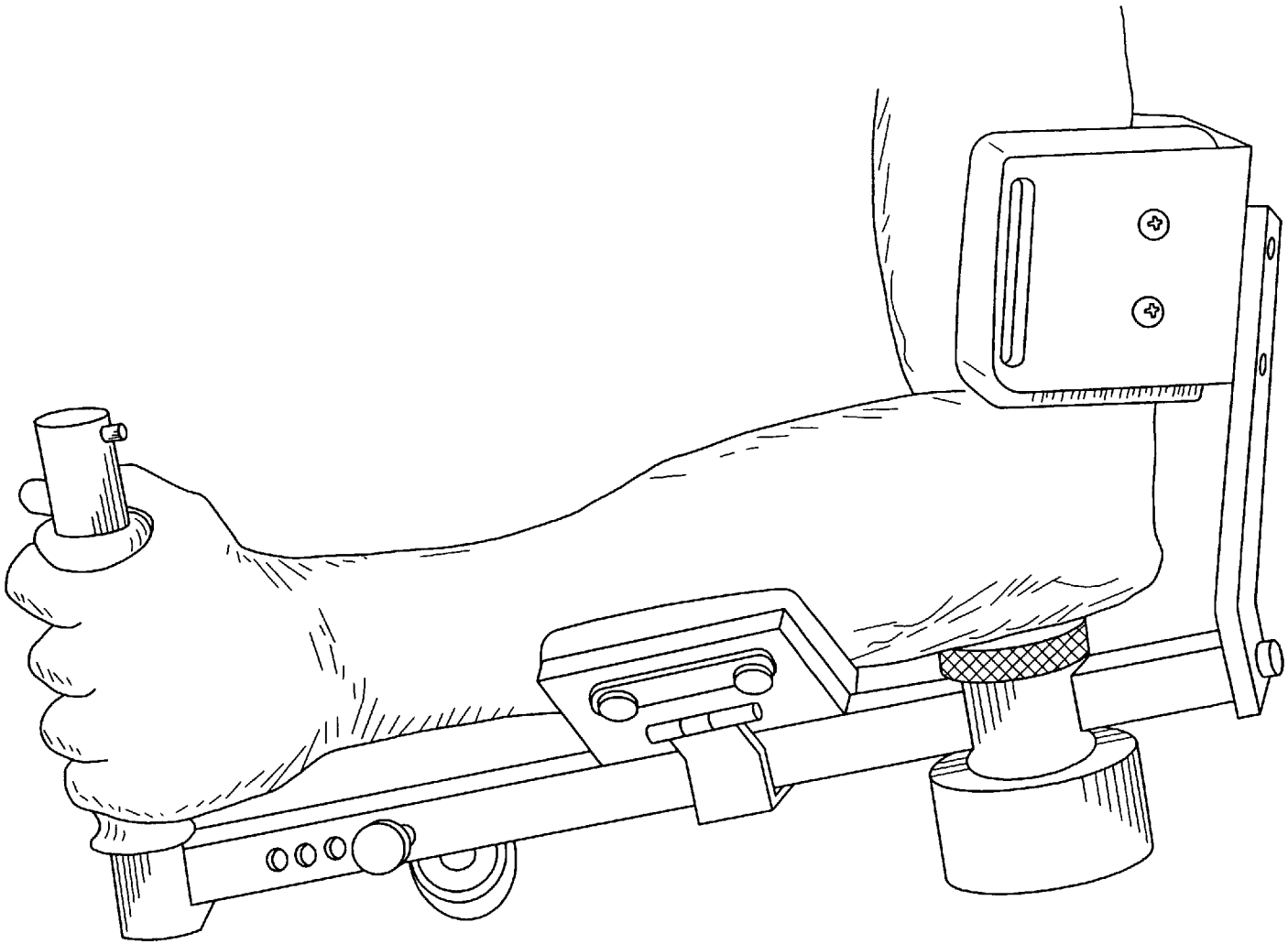
FIG. 10 shows the first embodiment, with optional arm/joint stabilizer, in use.
Figure 11:
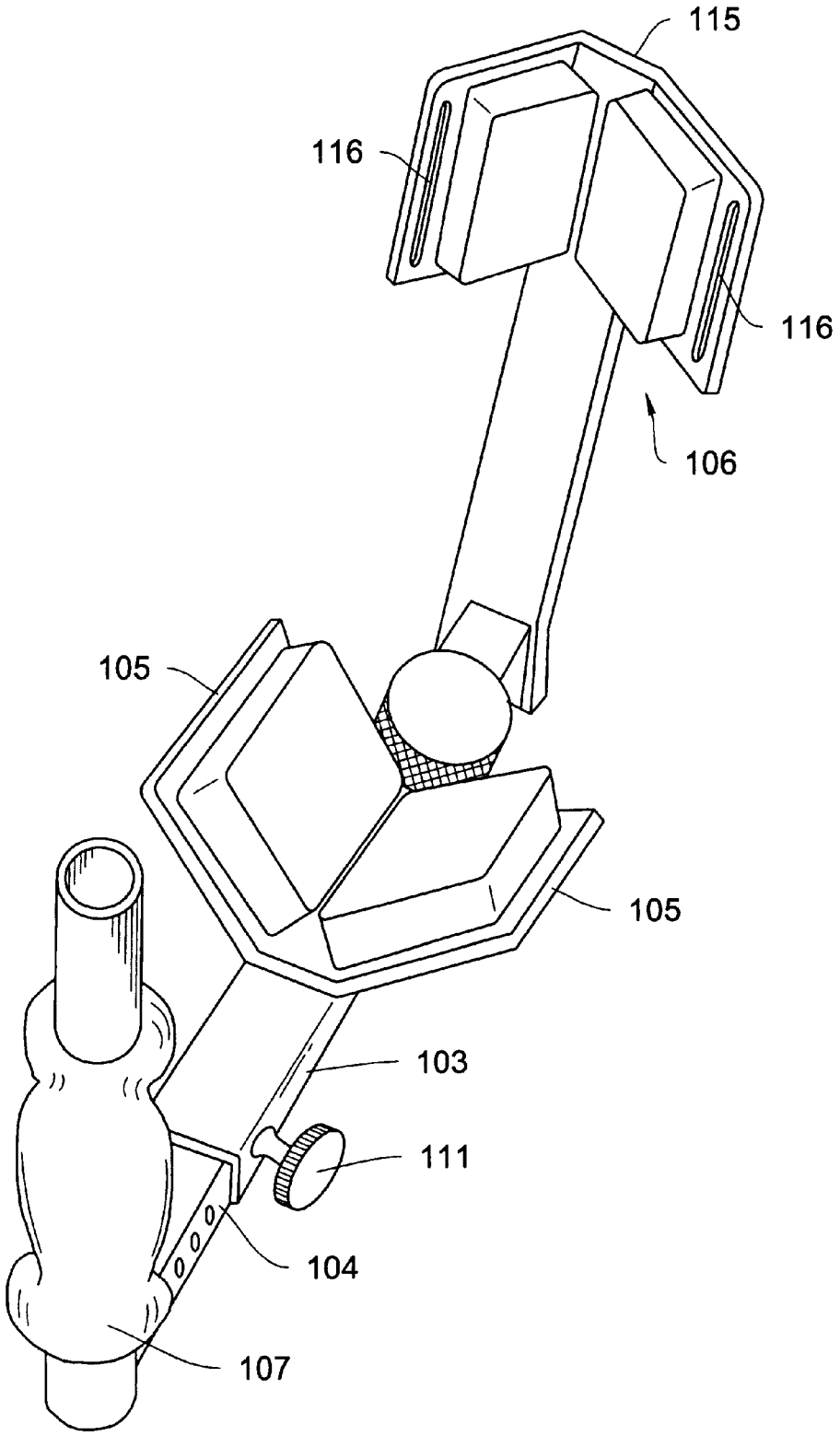
FIG. 11 is a near front perspective view of the first embodiment of the present invention with optional arm/joint stabilizer.
Figure 12:
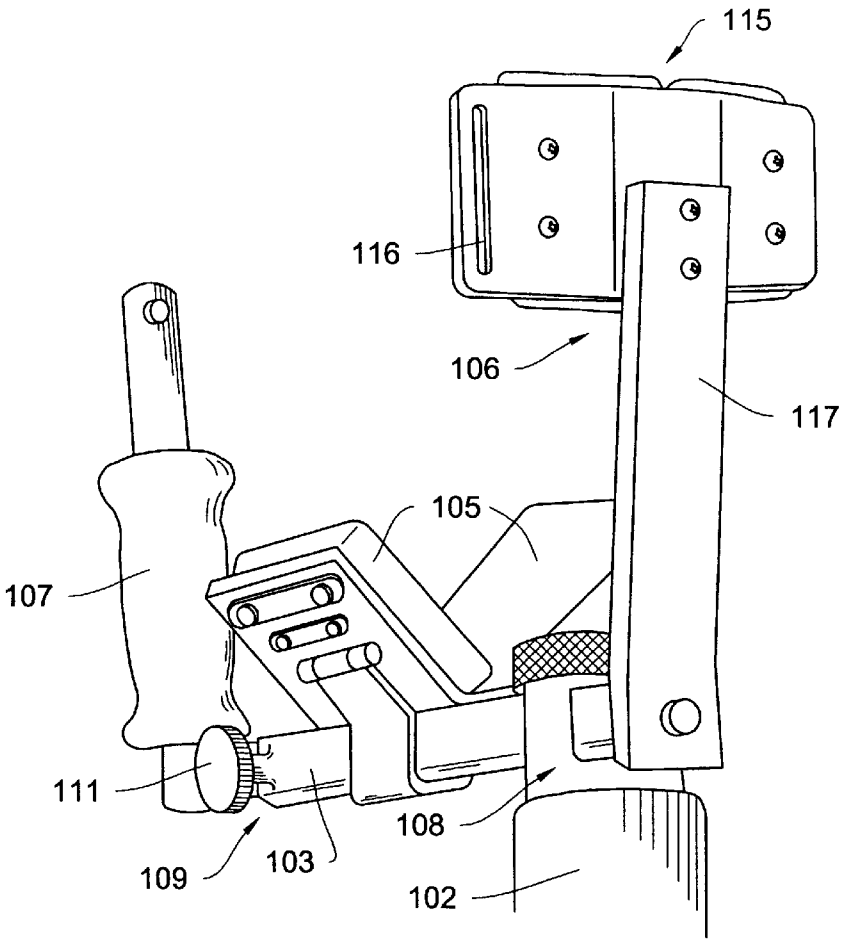
FIG. 12 is a rear facing perspective view of the first embodiment of the present invention with optional arm/joint stabilizer.
Figure 13:
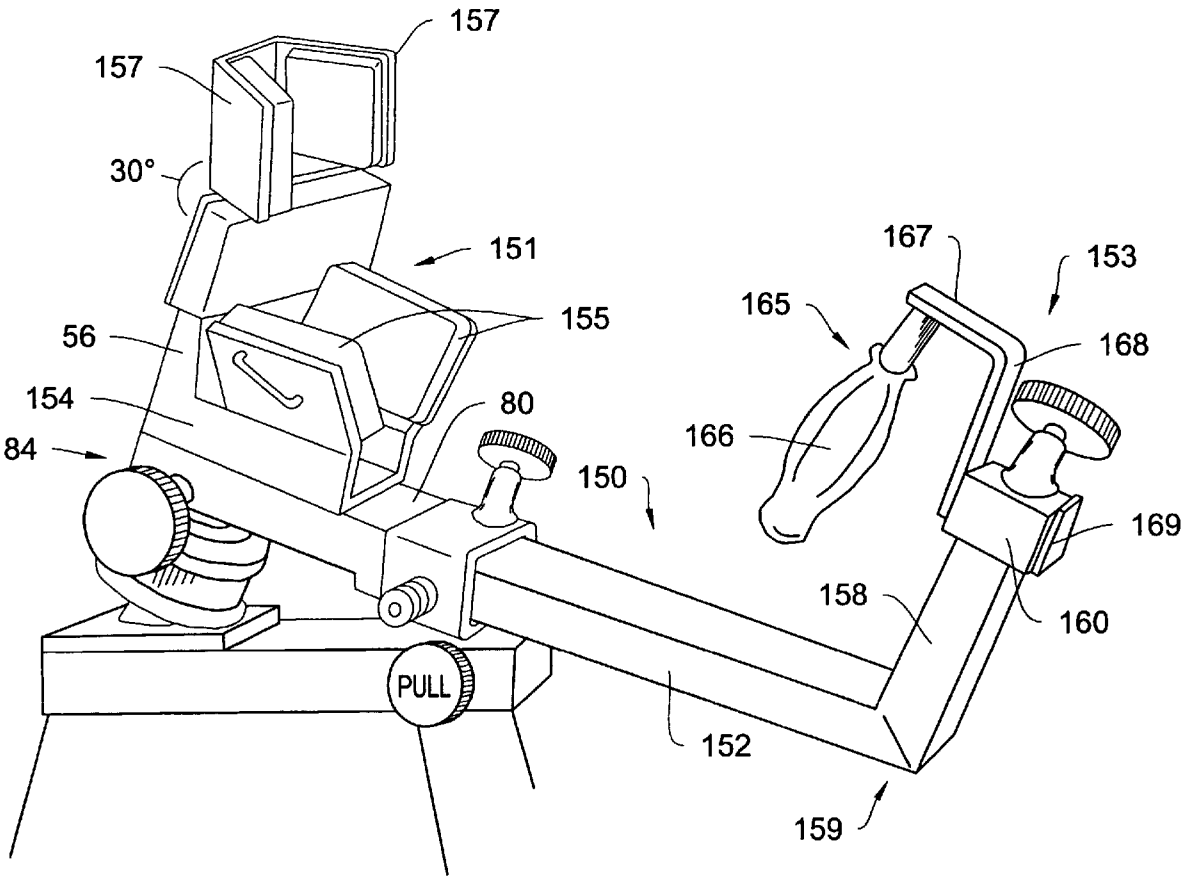
FIG. 13 is a side view of the second embodiment of the present invention with a second optional arm/joint stabilizer.
Figure 14:
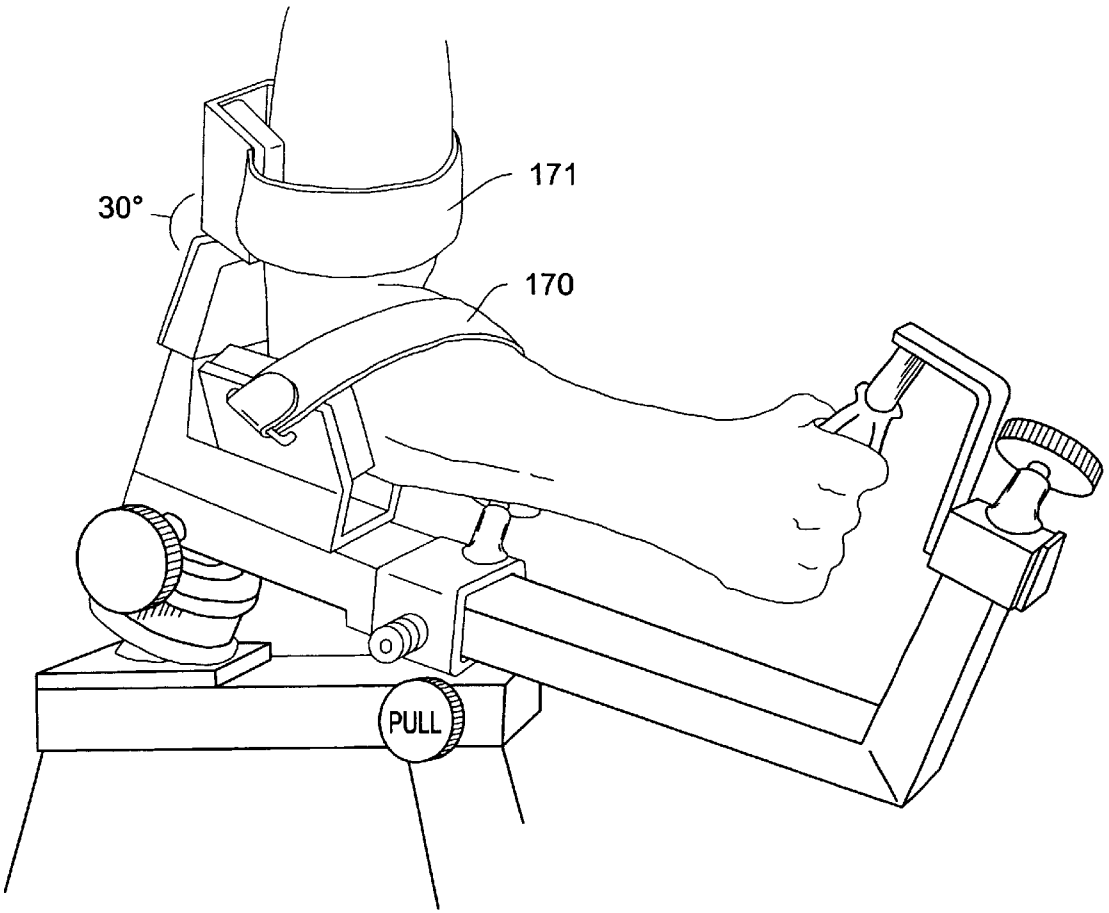
FIG. 14 shows the second embodiment with optional arm/joint stabilizer, in use.

The present invention is a new and useful exercise therapy device which utilizes a universal joint assembly to provide multiaxial rotational freedom that mimics the natural movements of arthrodial joints. The present invention is intended to be used in conjunction with existing exercise therapy equipment such as dynamometers.

A first preferred embodiment 1 of the present invention is constructed from a first major piece 10, a universal joint and a second major piece 40, an attachment adapter cap. The universal joint 10 is typically secured to a conditioning/rehabilitation/testing apparatus attachment shaft 11, located on, or within, an apparatus such as a dynamometer. The attachment adapter cap 40 is then secured to the universal joint. An alternate form of the device of the present invention utilizes an attachment adapter cap 40 that is integrally formed onto the universal joint 10. The device then secures onto the conditioning/rehabilitation/testing apparatus through threaded means or other equivalent securing structures.

In the first preferred embodiment, the apparatus attachment shaft 11 consists of a square shaft portion 12 having a distal end, said square shaft portion 12 projecting from an exterior surface of the apparatus. Located at the distal end of the square shaft portion 12 of the apparatus attachment shaft 11 is a threaded cylindrical attachment securing portion 13.

The universal joint 10 of the present invention may be chosen from any of the well known forms of universal joints, but the preferred form of universal joint is a constant velocity universal joint. A constant velocity universal joint is, in essence, at least two coupled universal joints. Since the angular rotational velocity of a single universal joint is dependent upon the angle of deflection from a zero angle rotational position, small deflections during exercise or conditioning will vary the rotational velocity of the exercise attachment thereby providing harmful stresses on the joints and muscles. Coupling more than one universal joint provides a constant velocity shaft rotation regardless of the angle of deflection from the zero angle rotation position. Since many conditioning and rehabilitation movements are sensitive to rotational velocity and changes in rotational velocity, a constant velocity universal joint provides optimum results.

The constant velocity universal joint 10 used in the description of the preferred embodiments is constructed from an outer casing 14, a middle ball bearing ring 15, an inner ball bearing retainer 16, and a multiplicity of ball bearings 17.

The outer casing 14 is a hollow cylindrical shaft with an outer surface 18, an inner surface 19, a front end 20, and a rear end 21. The inner surface 19 of the outer casing 14 is spherically formed. Spaced equidistantly about the inner surface's circumference are a multiplicity of outer casing ball bearing channels 22. The outer casing ball bearing channels 22 run linearly from the rear end 21 of the outer casing 14 to a point short of the front end 20 of the outer casing 14. The outer casing ball bearing channels 22 are sized to fit the ball bearings 17. Finally, the front end 20 of the outer casing 14 has a plurality of internally threaded securing bolt holes 23.

Located within the outer casing 14 is the middle ball bearing ring 15. The middle ball bearing ring 15 has a middle ball bearing ring outer surface 24, a middle ball bearing ring inner surface 25, a multiplicity of ball bearing apertures 26, and two parallel middle ball bearing ring ends. The middle ball bearing ring outer surface 24 is spherically formed to closely match the spherically formed inner surface 19 of the outer casing 14. This close match of the spherically formed outer casing inner surface 19 and the middle ball bearing ring outer surface 24 allows the middle ball bearing ring 15 to freely rotate within the outer casing 14. The ball bearing apertures 26 are equatorily and equidistantly spaced about the middle ball bearing ring 15. The ball bearings 17 are received into the ball bearing apertures 26 which are sized to fit the ball bearings 17 and are used to maintain ball bearing separation and relative position. The ball bearing apertures 26 align with the outer casing ball bearing channels 22. The middle ball bearing ring inner surface 25 is also spherically formed.

The inner ball bearing retainer 16 has an inner ball bearing retainer outer surface 27, an inner ball bearing retainer inner surface 28, a plurality of inner ball bearing retainer channels 29, and two parallel ends. The inner ball bearing retainer outer surface 27 is spherically formed to closely match the spherically formed middle ball bearing ring inner surface 25. This close match of the spherically formed middle ball bearing ring inner surface 25 and the inner ball bearing retainer outer surface 27 allows the inner ball bearing retainer 16 to freely rotate within the middle ball bearing ring 15. The inner ball bearing retainer channels 29 are equatorily and equidistantly spaced about the inner ball bearing retainer outer surface 27. The inner ball bearing retainer channels 27 run between the parallel ends of the inner ball bearing retainer 16. Furthermore, the inner ball bearing retainer channels 29 curve with an arc that is less than the curvature of the inner ball bearing retainer outer surface 27. The inner ball bearing retainer inner surface is formed to fit the dynamometer attachment shaft 11. The inner ball bearing retainer inner surface 28 may be formed to fit any attachment shaft 11 now existing or created in the future.

In this preferred embodiment, the inner ball bearing retainer inner surface 28 has a first section 30 running from a rear end 31 of the inner ball bearing retainer 16 to a point short of a front end 32 of the inner ball bearing retainer 16. The first section 30 is formed to receive the square shaft portion 12 of the apparatus attachment shaft 11. A second section 33 of the inner ball bearing retainer inner surface 28 is formed to receive the threaded cylindrical attachment section 13, thereby allowing the threaded cylindrical attachment section 13 to project from the constant velocity universal joint 10.

The constant velocity universal joint 10 is then attached to the apparatus by placing a lock washer 34 over the threaded cylindrical attachment section 13 and securing the constant velocity universal joint 10 with an internally threaded nut 35.

The attachment adapter cap 40, or second major piece, of the first preferred embodiment 1 is comprised of a securing ring 41, a short cylindrical tube 42, an end piece 43, and an adapter attachment shaft 44. The securing ring 41 has a plurality of equally spaced securing bolt apertures 45. The short cylindrical tube 42 is attached to the securing ring 41 at a first end 46. The end piece 43 is attached to a second end 47 of the short cylindrical tube 42. The adapter attachment shaft 44 is axially secured to an outer surface of the end piece 43. The adapter attachment shaft 44 can be formed to closely match any current or future conditioning/rehabilitation apparatus attachment shafts 11.

The attachment adapter cap 40 of the first preferred embodiment 1 is secured to the constant velocity universal joint 10 by placing a plurality of securing bolts 48 through the plurality of securing bolt apertures 45 and threading the plurality of securing bolts 48 into the plurality of securing bolt holes 23 located on the front end 20 of the outer casing 14. The plurality of securing bolts 48 may or may not include spacing and/or locking washers.

An apparatus attachment 101 is provided for use with the present invention. The apparatus attachment 101 comprises an attachment securing portion 102, a lever arm 103, an extension portion 104, a forearm rest 105, an arm/joint stabilizer 106, and a hand grip 107.

The attachment securing portion 102 attaches to the adapter attachment shaft 44 and receives the lever arm 103 through an aperture 108 adapted to receive the lever arm 103. The attachment securing portion 102 adjustably secures the received lever arm 103 with a friction nut or equivalent thereof. Thus, the lever arm 103 may be adjusted to provide any desired amount of torque on the adapter attachment shaft 44. Furthermore, the extension portion 104 is designed to be received in a first end 109 of the lever arm 103 and is adjustable by means such as a plurality of holes 110 through which a locking pin 111 is received. Additionally, the extension arm 104 may be further secured with a friction nut 112, or the like. Attached at a distal end of the extension portion 104 is the hand grip 107. The hand grip 107 is preferably in a fixed and perpendicular orientation to the apparatus attachment 101, but may be pivotally or rotatably attached, or the like.

The arm/joint stabilizer 106 has a support arm 114 attached at approximately 30 degrees to a second end 113 of the lever arm 103 with a spacer 113B. The approximate 30 degree angle of the support arm 114 provides comfort to the user in addition to physical support. The arm/joint stabilizer further has a V or U shaped arm support 115 attached to a distal end of the support arm 114. Preferably, the V or U shaped arm support 115 is padded and may have two elongated channels 116 designed to receive a restraining strap or the like. The arm/joint stabilizer 106 has been found to be extremely useful when used in conjunction with the present invention since it stabilizes the position of the arm and/or joint when the user is exercising a joint or muscle. Furthermore, when used with the restraining strap, the arm/joint stabilizer 106 prevents unwanted forearm pronation and supination during training with use of the multi-axial adapter of the present invention.

Finally, the forearm rest 105 is secured at an intermediate position to the lever arm 103. Preferably the forearm rest 105 is also a V or U shaped rest which is padded for the users comfort. The forearm rest 105 provides useful support of the forearm of a user during use of the present invention.

When in use, the first preferred embodiment is attached to a dynamometer and an apparatus attachment 101 is secured to the adapter attachment shaft 44. The lever arm 103 is adjusted such that when a user's arm is placed within the apparatus attachment 101 the rotational axis of the device is coaxial with the rotational axis of the joint being exercised. Furthermore, the extension portion 104 is adjusted to a length which allows the user to comfortably grasp the hand grip 107.

To use the device of the present invention, the user grasps the hand grip with his/her hand, rests his/her forearm in the forearm rest 105 and supports the upper arm with the arm/joint stabilizer 106. The user then rotates the apparatus attachment thereby transferring force through the lever arm to the adapter attachment shaft 44, which then transfers the torque through the universal joint 10 to the apparatus attachment shaft 11 and there through to the apparatus. More specifically, when used on the dynamometer, a target torque is dialed in and electronically controlled and the user applies sufficient force to the apparatus attachment 101 to obtain the target torque.

By using the constant velocity universal joint 10 the angular velocity of adapter attachment shaft 44 is the same as the angular velocity of the apparatus attachment shaft 11. The adapter therefore allows multi-axial rotation of the apparatus attachment 101 that is beneficial to conditioning and rehabilitation exercises. It accommodates to the physiological roll and glide of any arthrodial joint during training and rehabilitation of the joint or surround muscles.

A second preferred embodiment 2 utilizes the same universal or constant velocity universal joints 10 as the first preferred embodiment. The second preferred embodiment has a first major section 60, a second major section 70, and a third major section 80. The second major section 70 is the universal or constant velocity universal joint, preferably a constant velocity universal joint as described above in the first preferred embodiment.

The first major section 60 of the second preferred embodiment is an adapter matching insert 60. The adapter matching insert 60 is formed to fit a apparatus attachment receiver 50. In the second preferred embodiment 2, the adapter matching insert 60 is constructed starting with a square tubular section 61. Secured to a first end 62 of the square tubular section 61 is an insert spacer 63 that projects at a first end 64 of the insert spacer 63 over one side of the square tubular section 61. The insert spacer 63 is connected at a first end 64 of the insert spacer 63 to an insert attachment section 65 that is also connected to the constant velocity universal joint 70. In the second preferred embodiment 2, the insert attachment section 65 is connected to an inner ball bearing retainer portion of the constant velocity universal joint 70. Located near a second end 66 of the square tubular section 61 of the adapter matching insert 60 is a small retaining pin aperture 67 that receives a position retaining pin located near a first end of the apparatus receiver. Located near the first end 62 of the square tubular section 61 of the adapter matching insert 60 is a locking bolt 68. The locking bolt 68 is received in a locking bolt channel located at a second end of the apparatus attachment receiver 50. When engaged, the locking bolt 68 and locking bolt channel, in combination with the retaining pin aperture 67 and retaining pin, prevent relative movement between the adapter matching insert 60 and the apparatus attachment receiver 50.

The third major section 80 is an adapter matching attachment receiver 80. The adapter matching attachment receiver 80 is constructed of a square tubular section 81 that closely matches the apparatus attachment receiver 50 of the apparatus. The square tubular section 81 of the adapter matching attachment receiver 80 is attached to a front side of an outer casing of the constant velocity universal joint 70. Alternatively, the adapter matching insert 60 may be attached to the outer casing of the constant velocity universal joint 70 and the adapter matching attachment receiver 80 may be attached to the inner ball bearing retainer portion of the constant velocity universal joint 70. As part of the square tubular section 81 of the adapter matching attachment receiver 80 is an adapter locking bolt channel 82 located near a first end 83 of the square tubular section 81. This adapter locking bolt channel 82 receives locking bolts on apparatus attachments. At a second end 84 of the square tubular section 81 is an adapter retaining pin 85, located such that the adapter retaining pin 85 will be received within a retaining pin aperture on the apparatus attachment. Furthermore, the adapter matching attachment receiver 80 has a second locking bolt 86 located near the second end 84 of the square tubular section 81 at a vertex between two sides and aids prevention of relative motion between the adapter matching attachment receiver 80 and an apparatus attachment insert.

The second preferred embodiment has a second apparatus attachment 150 which improves its utility. The second apparatus attachment 150 has an upper arm support structure 151 which is attached to the adapter matching attachment receiver 80, and a second lever arm 152 with a hand grip structure 153 which is adapted to be received by the adapter matching attachment receiver 80.

The upper arm support structure 151 comprises an adjustable attachment section 154 which is secured to the second end 84 of the square tubular section 81 of the second preferred embodiment. The adjustable attachment section 154 has a pair of padded angled elbow rests 155 which support the user's elbow during use. Attached to the adjustable attachment section 154 is a support arm 156 attached a approximately a 30 degree angle with a V or U shaped upper arm support 157 located at a distal end thereof. As in the first embodiment, the approximate 30 degree angle of the support arm 156 provides comfort to the user in addition to physical support. The upper arm support 157, like the pair of elbow rests 155, is also padded.

The second lever arm 152 of the second apparatus attachment 150 is of square tubular construction and is adjustably received within the adapter matching attachment receiver 80. There is a perpendicular section 158 located at a distal end 159 of the second lever arm 152. Attached to a far end of the perpendicular section 158 is hand grip structure 153.

The hand grip structure 153 is a square tubular section 160 oriented parallel to the second lever arm 152 with a receive handle portion 160. Located on a top portion of the square tubular section 160 is an adjustment nut designed to adjustably secure the handle portion 165. The handle portion 165 is a hand grip portion 166 attached to a first handle section 167 which is further attached to a second handle section 168, said second handle section 168 finally being attached to the handle receiver section 169.

The user places his/her arm in the second apparatus attachment 150 by placing the elbow within the pair of angled elbow rests 155. The upper arm is placed within the V or U shaped upper arm support 157. The second lever arm 152 is adjusted to a position in which the user may comfortably grasp the hand grip portion 166 when using the device. To further stabilize the arm or joint, the user's arm may be secured within the apparatus attachment 150 by a first restraining strap 170 and a second restraining strap 171. The first restraining strap 170 is attached at first and second ends to each of the pair of elbow rests 155, respectively. The second restraining strap 171 is attached at first and second ends to each of the legs of the V or U shaped upper arm support 157, respectively.

Further embodiments may be constructed of combinations of the above elements and like receivers, inserts and shafts. One example, a third embodiment 3, provides an adapter that uses the constant velocity universal joint 10 of the first embodiment 1, and an adapter matching attachment receiver 80 in place of the adapter cap 40. This would effectively function to convert an attachment shaft type apparatus to an attachment receiver type of apparatus.

Alternatively, a fourth embodiment 4, provides an adapter constructed using the adapter matching insert 60 and the universal joint 70 of the second preferred embodiment 2, and the attachment adapter cap 40 of the first preferred embodiment 1. This would effectively function to convert an attachment receiver type apparatus to an attachment shaft type of apparatus.

Additionally, the universal joint, or constant velocity universal joint 10 may replace any drive shaft included in exercise, rehabilitation or testing machines. This would provide a machine with a universal drive shaft or constant velocity universal drive shaft.

Furthermore, simple changes such as reversing the orientation of the universal joint is considered within the scope of the invention.

While these descriptions directly describe the above embodiments, it is understood that those skilled in the art may conceive modifications and/or variations to the specific embodiments shown and described herein. Any such modifications or variations which fall within the purview of this description are intended to be included therein as well. It is understood that the description herein in intended to be illustrative only and is not intended to be limitative. Rather, the scope of the invention described herein is limited only by the claims appended hereto.

What is claimed is:

1. An apparatus adapter comprising a universal joint, said universal joint further comprising:

a. an outer casing,
   i. an outer surface,
   ii. an inner surface,
   iii. a front end and
   iv. a back end, b. a plurality of ball bearing channels located upon the inner surface of said outer casing, c. a middle ball bearing ring located within said outer casing, d. an inner ball bearing retainer located within said middle ball bearing ring, e. a plurality of first ball bearings, said first ball bearings located within the plurality of ball baring channels, f. a plurality of second ball bearings, said ball bearings located within said ball bearing retainer such that the middle ball bearing ring is allowed to freely move within the outer casing in a spherical movement pattern, g. said apparatus adapter further comprising a means for securing said universal joint to a user extremity for the purpose of exercise or rehabilitation.

2. The adapter as in claim 1 wherein the universal joint is a constant velocity universal joint.

3. The adapter as in claim 2 wherein the apparatus adapter further comprises an apparatus attachment attached to the universal joint, said apparatus attachment further comprises:

a. a lever arm attached to the constant velocity universal joint;

b. a hand grip attached to a first end of the lever arm; and c. an arm/joint stabilizer attached to a second end of the lever arm.

4. The adapter as in claim 2 wherein the apparatus attachment further comprises:

a) a lever arm attached to the constant velocity universal joint;

b) an extension portion adapted to be received by a first end of the lever arm;

c) a forearm rest attached at an intermediate point on the lever arm;

d) a hand grip attached to a distal end of the extension portion; and e) an arm/joint stabilizer attached to a second end of the lever arm.

5. The adapter as in claim 4 wherein the arm/joint stabilizer further comprises:

a) a support arm attached at a first end to the second end of the lever arm;

b) a V shaped upper arm support attached to a second end of the support arm, said upper arm support having two elongated channels adapted to receive a restraining strap; and c) a receiving strap.

6. The adapter as in claim 4 wherein the arm/joint stabilizer further comprises:

a) a support arm attached at a first end to the second end of the lever arm;

b) a U shaped upper arm support attached to a second end of the support arm, said upper arm support having two elongated channels adapted to receive a restraining strap; and c) a receiving strap.

7. The adapter as in claim 6 used in combination with an exercise machine.

8. The adapter as in claim 6 used in combination with a rehabilitation machine.

9. The adapter as in claim 6 used in combination with a testing machine.

* * * * *